US006147308A

United States Patent [19]

Santagata

[11] Patent Number: 6,147,308

[45] Date of Patent: Nov. 14, 2000

[54] HEATING CABLE CONNECTOR FOR RAILROAD SWITCH HEATING SYSTEM

[76] Inventor: Daniel A. Santagata, 1 Old New England Rd., Branford, Conn. 06405

[21] Appl. No.: 09/247,433

[22] Filed: Feb. 10, 1999

Related U.S. Application Data

[62] Division of application No. 09/046,415, Mar. 23, 1998, Pat. No. 5,941,482.

[51] Int. Cl.[7] ..... H02G 15/02

[52] U.S. Cl. ..... 174/75 R; 174/88 C; 439/578

[58] Field of Search ..... 174/75 R, 78, 174/88 C; 439/578, 879

[56] References Cited

U.S. PATENT DOCUMENTS

| | | | |
|---|---|---|---|
| Re. 31,081 | 11/1982 | Keep, Jr. . | |
| 3,944,716 | 3/1976 | Katzbeck et al. | 174/21 R |
| 4,383,131 | 5/1983 | Clabburn | 174/88 C X |
| 4,388,523 | 6/1983 | Keep, Jr. et al. . | |
| 4,391,425 | 7/1983 | Keep, Jr. . | |
| 5,015,805 | 5/1991 | Beckloff et al. | 174/88 C X |
| 5,704,809 | 1/1998 | Davis | 439/578 |
| 5,722,856 | 3/1998 | Fichs et al. | 439/578 |

FOREIGN PATENT DOCUMENTS 1128636 7/1982 Canada .

*Primary Examiner*—Dean A. Reichard
*Assistant Examiner*—Chau N. Nguyen
*Attorney, Agent, or Firm*—St. Onge Steward Johnston & Reens LLC

[57] ABSTRACT

A heating cable assembly includes a connector having a sleeve, and a heat-absorbing electrically conductive core member within the sleeve. The assembly also includes a heating cable having an electrical resistance heating wire extending from the core member out a first end of the sleeve, and a water-proof, heat conductive, spirally fluted tube encasing the heating cable. According to one embodiment, the connector further includes an electrically conductive expansion joint extending from the core member opposite said heating wire. According to an additional embodiment, the assembly includes a weld connecting the spirally fluted tube to the first end of the sleeve.

6 Claims, 4 Drawing Sheets

HEATING CABLE CONNECTOR FOR RAILROAD SWITCH HEATING SYSTEM

This application is a divisional application of Ser. No. 09/046,415 filed Mar. 23, 1998, now U.S. Pat. No. 5,941, 482.

FIELD OF THE INVENTION

The present invention relates to a heating cable and, more particularly, to a railroad switch heater. Even more particularly, the invention relates to a heating cable assembly and a connector for a railroad switch heating system.

BACKGROUND OF THE INVENTION

The present invention relates to apparatus for heating a railroad switch to prevent obstruction of the switch operation by ice or snow in cold weather conditions. In climatic regions that frequently experience temperatures below freezing, malfunction of railroad track switches is often a problem. This difficulty is compounded by frequent precipitation in the form of snow or freezing rain. Temperatures below freezing and accumulations of snow or ice may result in malfunction of railroad switches.

The heating of a railroad rail switch to prevent failure or unreliability of the switch operation under cold weather conditions involves a variety of problems and needs. The heating apparatus to be employed must serve reliably to keep the switch clear of ice and snow, with safety and efficiency in its operation, economy in the production and installation of its component parts, and assurance that failures of operation due to short-circuiting for example will not occur over long periods of service. It is also important that the apparatus be susceptible to safe installation by railroad workmen, to prompt repair at the switch location in the event of damage by accident or otherwise, and to fast removal and replacement whenever needed to enable repair or replacement of the rails, ties, or other structures at the switch.

These problems and needs have been satisfactorily met by the railroad switch heating system disclosed in U.S. Pat. Nos. Re. 31,081 and 4,388,523. These patents disclose an electrical resistance heating wire enclosed inside a substantially coextensive length of water-impervious, bendable tubing. The heating wire is provided on each of its ends with connectors for connecting it in a circuit containing other heating wires and a source of current for electrifying the heating wires such that they produce heat.

A length of such heating cable is disposed against a fixed rail adjacent to displaceable rail end portions of the railroad switch, in heat conducting relation thereto. High temperature resistant thermal insulation is held against the cable by channel members to prevent heat losses by convection and radiation. The heating of the fixed rails by conduction from the cable lengths results in conduction of heat to other parts of the switch.

The heating system also includes crib heating units fitting into crib spaces of the track, beneath tie rods of the switch. Each crib unit comprises a unitary elongate, substantially flat pan-like support of thermally conductive, heat and weather resistant sheet material, such as stainless steel or aluminum sheeting. The support is dimensioned to fit between and along the track ties bordering the crib space. A sinuously bent length of the electrical heating cable is arranged over and held to a surface of the pan-like support so as to heat the support substantially uniformly by conduction and thus heat substantially the entire region of the crib space by convection and radiation.

A connector according to the present invention is particularly useful, for example, for joining an end of the electrical resistance heating wire enclosed within the protective tubing with an insulated electrical conductor so that the connector not only makes an efficient electrical connection between the wires but, in addition, prevents harmful conduction of heat from the heating wire to the insulated conductor, enables quick disconnection or reconnection of the insulated conductor, and enables the joint to be made water-tight to avoid hazards of a short circuit. The connector should preferably also absorb thermal contractions and expansions caused by the cooling and the heating of the heating wire.

U.S. Pat. No. 4,391,425 discloses a connector including a heat-absorbing, electrically conductive core member that receives and is clamped onto an end of the core wire of the heating cable and an end of a wire of the insulated conductor. The core member is enclosed in electrically insulating material confined inside a rigid protective sleeve. A length of rigid smooth tubing encloses the heating cable and is joined in a water-tight manner to an end of the protective sleeve with a compression coupling. The insulated conductor is also joined in a water-tight manner to an opposite end of the protective sleeve with a compression coupling.

Thus, a water-tight connector exists that electrically joins a heating cable to an insulated conductor, yet absorbs and dissipates heat from the heating cable so as to prevent excessive heating of the insulated conductor. The connector also accommodates the thermal expansions and contractions that occurred with heating and cooling of the heating cable, and provides protection from water leakage.

What is desired, however, is a connector for joining an electrical heating cable with an insulated conductor that provides increased thermal expansion relief. What is also desired is an electrical heating cable having a protective tubing that provides increased heat conductivity.

SUMMARY OF THE INVENTION

A general object of the present invention, accordingly, is to provide an improved connector for joining an electrical heating cable with an insulated conductor.

A more specific object of the present invention is to provide a connector supplying increased thermal expansion relief.

Another object of the present invention is to provide a connector having enhanced weather-proofing.

An additional object of the present invention is to provide a connector having superior heat sinking.

A further object of the present invention is to provide an electrical heating cable assembly having increased heat conductivity.

These and other objects of the present invention are achieved by a connector for joining first and second wires, at least one of which may be subject to elongation. The connector includes a protective sleeve having a first end for receiving the first wire and a second end for receiving the second wire. A heat-absorbing electrically conductive core member is received within the protective sleeve for connection to the first wire, and an electrically conductive expansion joint extends from the core member for connection to the second wire. The expansion joint, as its name implies, absorbs the thermal expansions and contractions of the wires to prevent damage to a heating cable assembly incorporating the connector.

According to one aspect of the present invention, the expansion joint is provided in the form of a tubular braid.

The present invention also provides an electrical heating cable assembly including a connector, an electrical heating cable and a water-proof, heat conductive, spirally fluted tube encasing the heating cable. The spirally fluted tube allows easy bending of the cable assembly, and produces excellent heat conductivity through radially extending spiral flutes.

According to one aspect of the present invention, the spirally fluted tube has an inner diameter that is substantially equal to an outer diameter of the heating cable to eliminate thermal conductive inhibiting air spaces between the tube and the cable.

According to another aspect of the present invention, a water-tight coupling in the form of a weld is provided between the spirally fluted tube and the connector.

Rail-heating and crib heating units incorporating the heating cable assembly and the connector according to the present invention are also provided.

The invention and its particular features and advantages will become more apparent from the following detailed description considered with reference to the accompanying drawings.

DETAILED DESCRIPTION OF THE INVENTION

Figure 1:
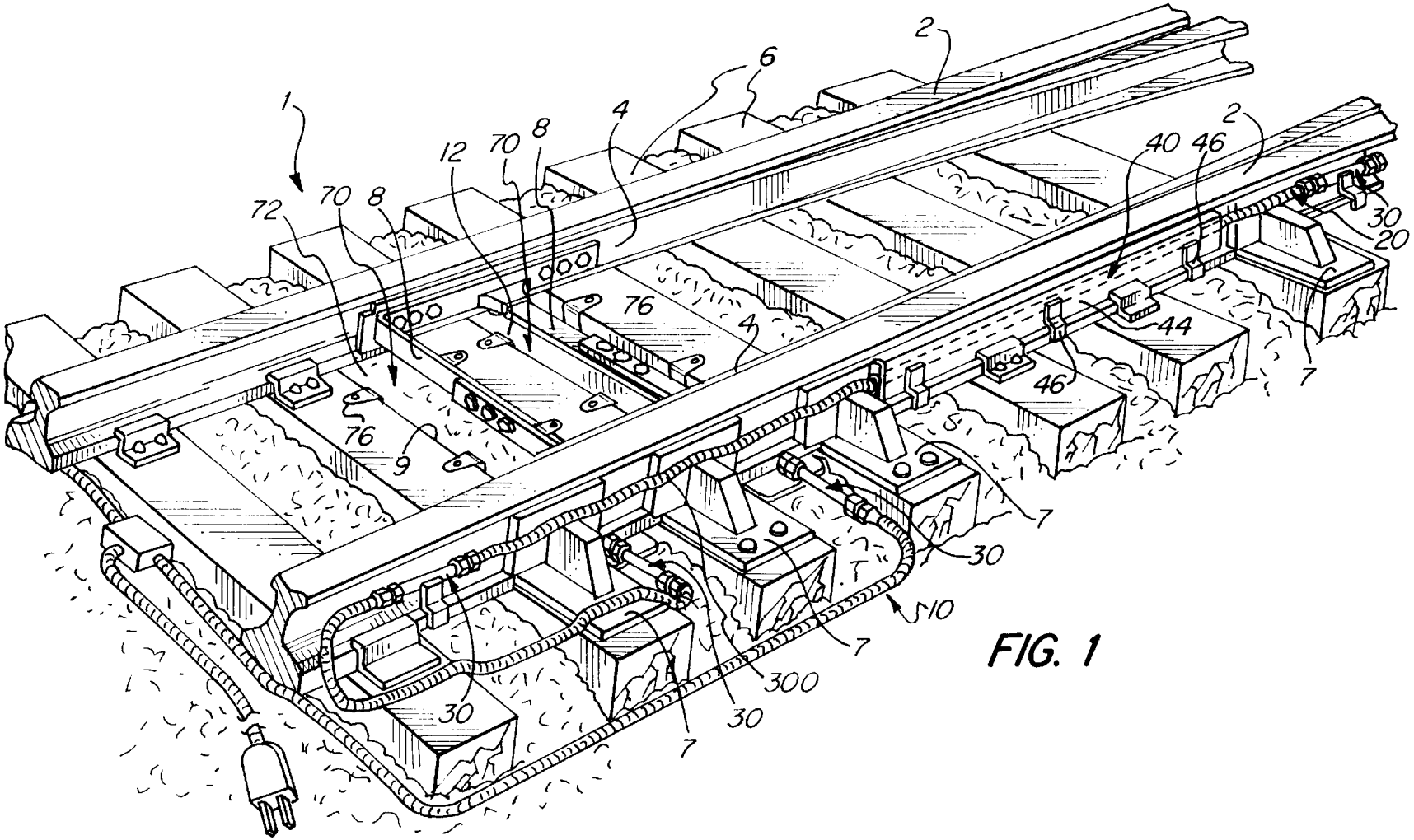
FIG. 1 is an isometric view of a railroad switch heating system according to the present invention mounted on a railroad track switch.

A typical railroad switch 1 to be equipped with a heating system 10 according to the present invention, as illustrated in FIG. 1 of the drawings, comprises two fixed rails 2 with switch rails 4 positioned between the fixed rails. The fixed rails 2 are fastened to track ties 6 and are supported at intervals along their outer sides by track braces 7 fixed to ties. The switch rails 4 are joined together by connector rods 8 that extend along crib spaces 9 between ties 6.

The railroad switch 1 is only disclosed here in as much detail as necessary to describe the present invention. The structure and operation of a railroad switch, however, is generally known to those skilled in the field of the present invention. Nevertheless, such structure and operation is disclosed in more detail in U.S. Pat. Nos. Re. 31,081 and 4,391,425, which are incorporated herein by reference.

As shown in FIGS. 1 through 8, the heating system 10 according to the present invention includes high temperature electrical heating cable assemblies 20, which include connectors 30, disposed against the fixed rails 2. The heating system 10 also includes rail heating units 40 for heating the rails 2, 4, and crib heating units 70 for heating the crib spaces 9 occupied by the connecting rods 8.

Figure 9:
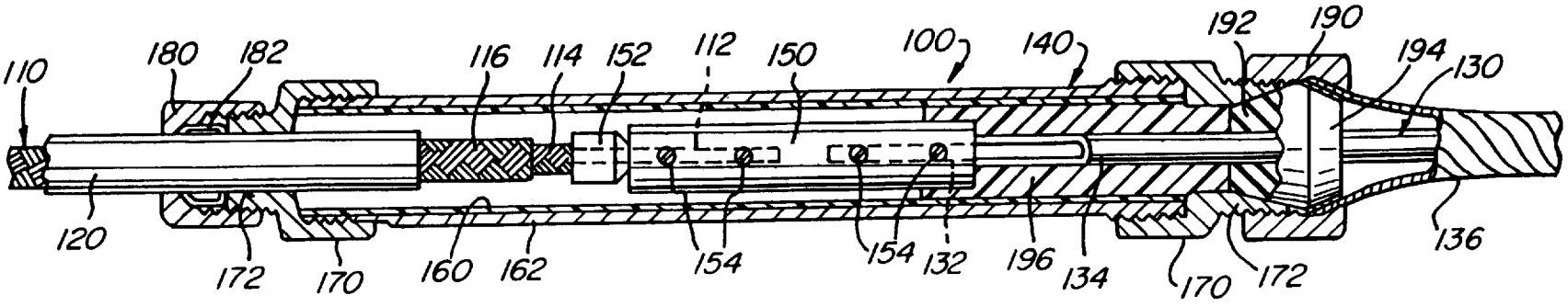
FIG. 9 (PRIOR ART)
FIG. 9 is a side elevation view, partially in section, of a prior art heating cable assembly and connector.

Referring to FIG. 9, a prior art heating cable assembly 100 is shown for comparison with the present invention. The heating cable assembly is disclosed in further detail in U.S. Pat. No. 4,388,523, which is incorporated herein by reference.

The prior art assembly 100 includes a heating cable 110 having a single solid strand of high temperature electrical resistance heating wire 112, with a highly heat-resistant yet thermally conductive, electrical insulating layer 114 enclosing the wire and confined inside a highly heat-resistant yet thermally conductive shielding layer 116. The heating wire 112, for instance, is a No. 12 gauge wire of a nickel-chromium alloy, such as the alloy of 80% nickel and 20% chromium known as Nichrome, having a diameter of about 0.081 inch. The electrical insulating layer 114 is preferably formed of several layers of a ceramic fiber, typically three, braided over the heating wire. A commercially available ceramic fiber made of an alumina-boria-silica composition and identified as "3M Fiber AB-312," if suitably pre-treated to burn off a sizing that may carbonize at high temperature, is advantageous for making the insulating layer. This material when so pre-treated exhibits excellent dielectric properties and retains needed flexibility after long periods of heating to temperatures in excess of 2,000° F. which exceed the temperature reached by the heating wire 112 in use. Alternatively, the insulating layer may be composed of other ceramic substances that will resist temperatures of at least about 2,000° F. over long periods of service, such for instance as an amorphorous silica fiber known as "REFI-SIL." The shielding layer 116 confining the insulating layer 114 is a pliable sheath composed of a metal highly resistant to heat, abrasion and oxidation, and preferably is formed by braiding wires of a copper-nickel alloy such as "INCONEL" into a sleeve fitting tightly on the insulating layer.

The heating wire 112 and layers 114,116 are enclosed inside a length of water-impervious, bendable metal tubing 120, such for instance as extruded aluminum tubing having an inside diameter of about 0.5 inch and a wall thickness of about 0.05 inch. By excluding water from access to the heating cable 110, the tubing 120 prevents current losses, short circuit or burn-out by water or other liquid. The risk of water causing failure of the switch heating system is avoided further by the connector 140 provided for joining the heating wire 112 with an insulated electrical conductor 130 of a current supply circuit.

The insulated conductor 130 may be, for instance, a No. 8 gauge, highly conductive wire ("cold wire") 132 encased in a jacket of silicone rubber or rubber-like insulation 134. The current source typically supplies a 110 V or 220 V AC current to the electrical resistance heating wire 112 at a current density of, for example, 20 to 40 or more watts per square inch. The current thus provides enough power to bring the heating cable 110 to a temperature, for instance, of about 1250° F. at an ambient temperature of 0° F.

The connector 140 includes a tubular core member 150 of electrically conductive metal, such as brass or copper, which serves as a heat sink that stops the extreme heat of the heating wire 112 from passing to, and damaging the insulated conductor 130. The heating wire 112 is inserted into and fastened in one end of the core member 150, and the cold wire 132 is inserted into and fastened in the other end of the core member. The core member 150 may be crimped at both ends, to permanently clamp the wires 112, 132 to the core member. Preferably, however, the core member 150 includes threaded radial bores in which set-screws 154 are fitted, so that the wires 112, 132 are releasably clamped in place by the screws. The set-screws 154 thus enable quick disconnection and removal, or quick connection, of the wires 112, 132 whenever desired for disassembly or assembly of the joint formed by the connector 140.

To prevent a short-circuit, an electrically insulating ceramic bead 152 is fitted over the heating wire 112 to hold the outer, electrically conductive, shielding layer 116 away, and electrically insulated from, the heating wire and the core member 150. The tubular core member 150, with the wires 112, 132 attached, is enclosed in a surrounding electrical and thermal insulator 160, such as a tube of "Teflon" about 1/16 inches thick. The insulation 160 in turn is confined inside a rigid sleeve 162, which has coupling rings 170 fixed onto its ends. The sleeve 162, for instance, is a 6½ inches long piece of aluminum tubing having an inside diameter of about 9/16 inches.

A cap ring 180 receives a compressible ring 182 that fits onto the tubing 120 enclosing the heating cable 110. The cap ring 180 is fastened to the tubing 120 by compressing the compressible ring 182 onto the tubing as the cap ring is screwed onto a shank 172 of the coupling ring 170. A screw collar 190 is coupled with the end of a spiral shield 136 that fits over and protects a portion of the insulated conductor 130 adjacent the connector 140. An electrically insulating, heat-resistant elastic bushing 192, and an adjacent washer 194 both fit inside the screw collar 190 around the insulated conductor 130, so that the bushing is pressed and sealed against the insulated conductor and against the coupling ring 170 when the screw collar is screwed onto the ring. Preferably, the core member 150 and the insulated conductor 130 inside the sleeve 162 are embedded in flexible silicone sealing compound 196 to further prevent moisture from entering the connector 140, yet permit expansion and contraction of the core member and the joined wires 112, 132.

By virtue of the described construction, the prior art connector 140 makes a secure yet readily separable electrical connection between the heating wire 112 and the cold wire 132, while accommodating the thermal expansions and contractions of the wires and the connector parts. The connector 140 also effectively serves as a heat barrier to prevent injurious flow of heat from the heating wire 112 to the insulated conductor 130 and, in addition, renders the electrical joint substantially water-tight.

Figure 2:
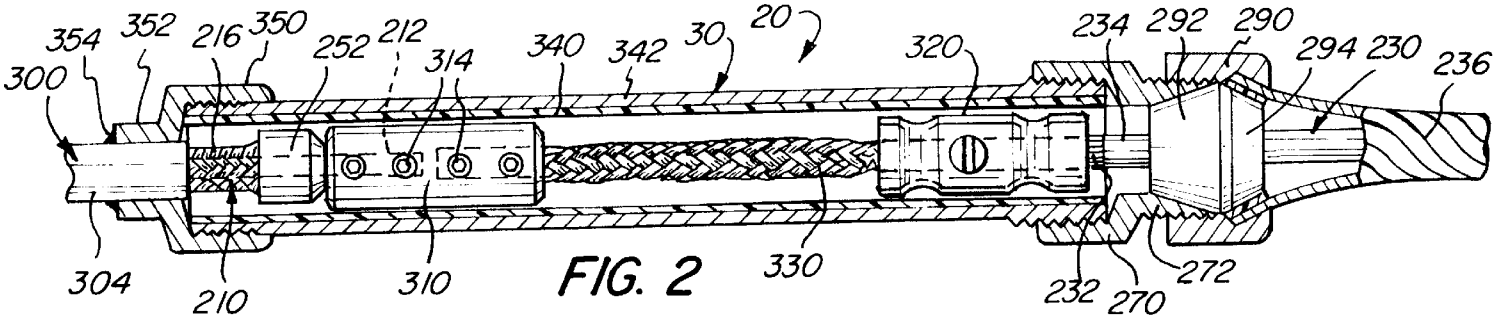
FIG. 2 is a side elevation view, partially in section, of a heating cable assembly and a connector of the heating system of FIG. 1.
Figure 3:
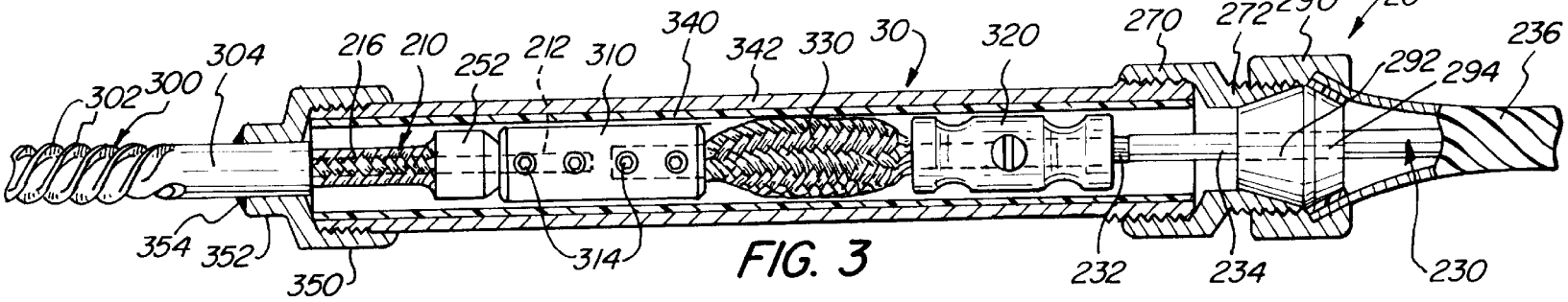
FIG. 3 is a side elevation view, partially-in section, of the heating cable assembly and the connector of FIG. 2 showing an expansion joint of the connector absorbing thermal elongation of a heating wire.
Figure 4:
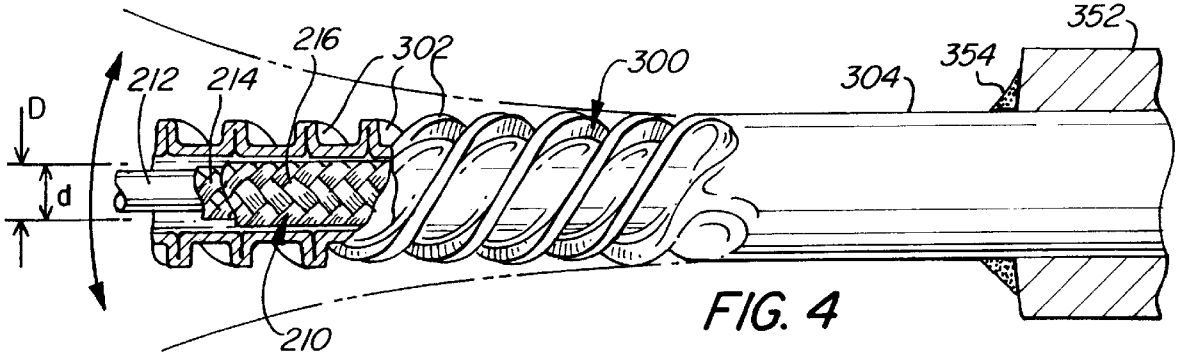
FIG. 4 is an enlarged side elevation view, partially in section, of the heating cable assembly and the connector of FIG. 2 showing a spirally fluted tubing of the heating cable in greater detail.

Referring now to FIGS. 2 through 4, the heating cable assembly 20 according to the present invention is shown. The heating cable assembly 20 is similar in some respects to the prior art heating cable assembly 100 of FIG. 9 and elements that are the same have reference numerals with the same last two numbers, but preceded by a "2" instead of a "1".

The heating cable assembly 20 includes a heating cable 210 that is encased in a water-impervious, heat conducting, bendable spirally fluted tube 300, and joined to a connector 30. The spirally fluted tube 300 is available from Thermodynetics Corporation of Windsor, Connecticut under the trademark TURBOTEC. Preferably, the spirally fluted tube 300 is made of either copper or stainless steel, so that the coefficient of thermal expansion of the fluted tube will more closely equal the coefficient of thermal expansion of the heating cable 210. In this way, the spirally fluted tube 300 and the heating cable 210 will expand and contract at substantially the same rate when heated, eliminating the possibility of breaks or leaks due to unequal expansion and contraction. Furthermore, the spirally fluted tube 300 preferably has an inner diameter d that is substantially equal to an outer diameter D of the heating cable 210, such that there is substantially no air space between the tube and the heating cable to act as a thermal insulator and impede thermal conduction between the cable and the tube. Spiral flutes 302 of the spirally fluted tube 300 efficiently radiate heat from the heating cable 210 yet allow the tubing to be easily bent for mounting on the railroad switch 1.

The connector 30 includes a tubular core member 310 of electrically conductive metal, such as brass or copper, which serves as a heat sink for absorbing the extreme heat of the heating wire 212. The heating wire 212 is inserted into and fastened in an end of the core member 310. The connector 30 also includes an uninsulated, copper butt crimp 320, which is crimped onto the cold wire 232. It should be noted, however, that the butt crimp 320 could be replaced with a second tubular core member.

Extending between the core member 310 and the butt crimp 320 is an electrically conductive thermal expansion joint 330. Preferably, the thermal expansion joint comprises a tubular expansion braid 330. Even more preferably, the tubular expansion braid 330 is made of tin-plated copper. As shown between FIGS. 2 and 3, the expansion braid 330, while providing electrical conduction between the heating wire 212 and the cold wire 232, expands and contracts in response to thermal expansions and contractions of the heating cable 210. The expansion braid 330 thereby relieves stresses due to expansions and contractions within the heating cable assembly 20.

The core member 310 may be crimped at both ends, to permanently clamp the wires 212 and the expansion braid 330 to the core member. Preferably, however, the core member 310 includes threaded radial bores in which set-screws 314 are fitted, so that the wire 212 and the expansion braid 330 are releasably clamped in place by the screws. The butt crimp 320, however, is simply crimped onto the expansion braid 330. The tubular core member 310, the butt crimp 320, with the wires 212, 232 and the expansion braid attached 330, are enclosed in a surrounding electrical and thermal insulator 340, which in turn is confined inside a rigid sleeve 342. The sleeve 342 is elongated in comparison to the sleeve 162 of the prior art connector 140 in order to accommodate the thermal expansions and contractions of the expansion braid 330, and, for instance, is an 8 inch long piece of aluminum tubing.

A water-tight coupling is formed between a smooth end portion 304 of the spirally fluted tubing 300 and the rigid sleeve 342 of the connector 30. Preferably, this water-tight coupling comprises a coupling ring 350 screwed onto the end of the sleeve 342, and having a smooth shank 352 joined to the smooth end portion 304 of the spirally fluted tube 300 with a weld 354. The weld 354 is provided in a continuous ring between the shank 352 of the coupling ring 350 and an outer circumference of the tube 300, and is preferably formed from silver solder.

Figure 5:
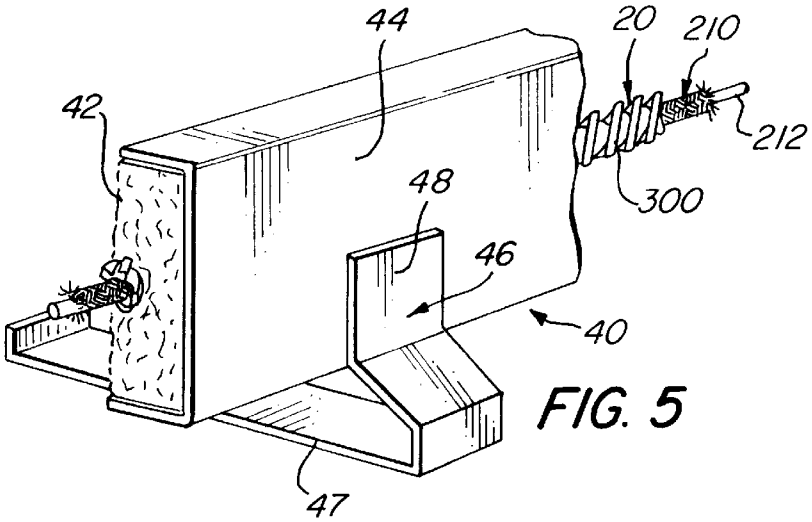
FIG. 5 is an enlarged isometric view of a rail heating unit of the railroad switch heating system of FIG. 1.

Referring now to FIGS. 1 and 5, some of the heating cable assemblies 20 are disposed directly against and along the outer sides of the webs of the fixed rails 2 at locations between the rail braces 7. At the braces 7, the heating cable assemblies 20 are bent over and against the braces to heat the rails 2, 4 by conduction through the braces.

The rail-heating unit 40 according to the present invention includes the portion of the heating cable assembly 20 engaged directly against the fixed rail 2, and an elongate mat 42 of high temperature resistant thermal insulation, such as ceramic fiber insulation, covering the portion. The thermal insulating mat 42 is confined against the portion of the heating cable assembly 20, and against the rail 2 by a channel member 44 clamped against the rail. The thermal insulating mat 42 prevents heat losses that otherwise would occur by convection and radiation away from the rail 2.

The insulating mat 42 may be grooved-longitudinally on one side to receive the heating cable assembly 20, and is advantageously formed of "Thermo-Fiber" at a density of about eight pounds per cubic foot. The insulating mat 42 can alternatively be made of bonded insulating ceramic fiber, or fiberboard, such for example as the commercial heat insulating material known as "K-FAX." The insulating mat 42 could also be made of loose ceramic fiber insulation, for instance "KAOWOOL" at a density of about eight pounds per cubic foot, confined in a flexible sleeve of high temperature resistant wire mesh, such as "INCONEL 600."

The channel member 44 is an extruded or an otherwise formed elongate section of a suitable rigid sheet material, such as an aluminum extrusion, having a generally U-shaped cross-section. The "U" of the channel member 44 has a depth substantially equal to a thickness of the insulating mat 42 such that the channel member tightly confines the mat and the cable assembly 20 against the rail 2. The channel member 44 is clamped in place at spaced intervals by suitable displaceable holding devices such as channel clips 46. Each of the clips 46 comprises a flat bar of spring steel shaped to form an anchoring portion 47 and an angled upright resilient leg 48. The anchoring portion 47 is snapped onto the base flange of the rail 2, causing the resilient leg 48 to bear firmly against the channel member 44 to hold the channel member tightly against the rail.

Figure 6:
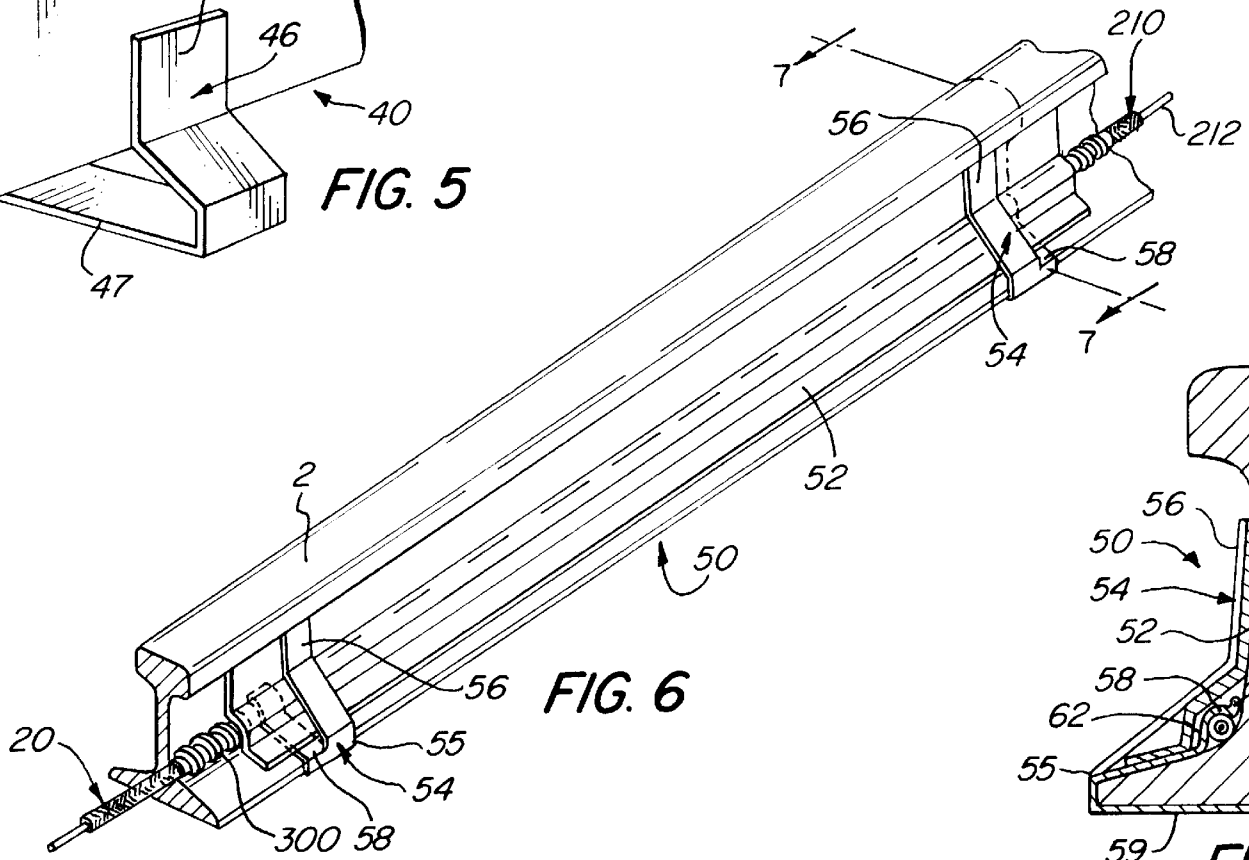
FIG. 6 is an isometric view of another rail heating unit according to the present invention.
Figure 7:
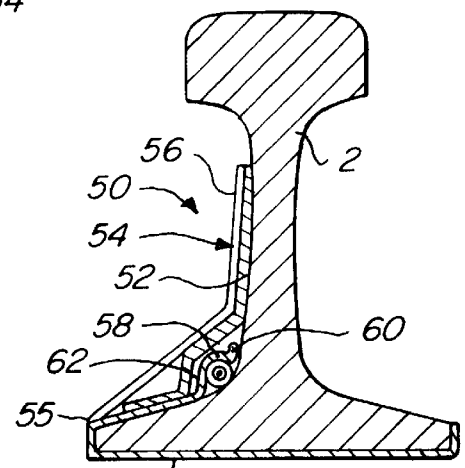
FIG. 7 is a sectional view of the rail heating unit of FIG. 6 taken along line 7—7 of FIG. 6.

Referring to FIG. 6 and 7, another rail-heating unit 50 according to the present invention is shown. The rail-heating unit 50 includes the portion of the heating cable assembly 20 engaged directly against the rail 2, and an elongate mat 52 of high temperature resistant thermal insulation, such as ceramic fiber paper. The ceramic fiber paper 52 is clamped in place against the portion of the heating cable assembly 20, and against the rail web surfaces adjacent to them, by spaced-apart insulation clips 54. Each of the insulation clips 54 comprises a flat bar of spring steel shaped to form an anchoring portion 55 and an angled upright resilient leg 56, similar to the channel clips 46 of FIG. 5. The rail-heating unit 50 also includes cable clips 58, which clamp the heating cable assembly 20 directly against the rail 20 and form an air space 62 between the heating cable assembly and the ceramic fiber paper 52. The air space 62 acts as an oven to increase the temperature rise and response time of the heating cable assembly 20. Each of the cable clips 58 comprises a flat bar of spring steel shaped to form an anchoring portion 59 and an angled upright resilient leg 60, similar to the channel clips 46 of FIG. 5.

Figure 8:
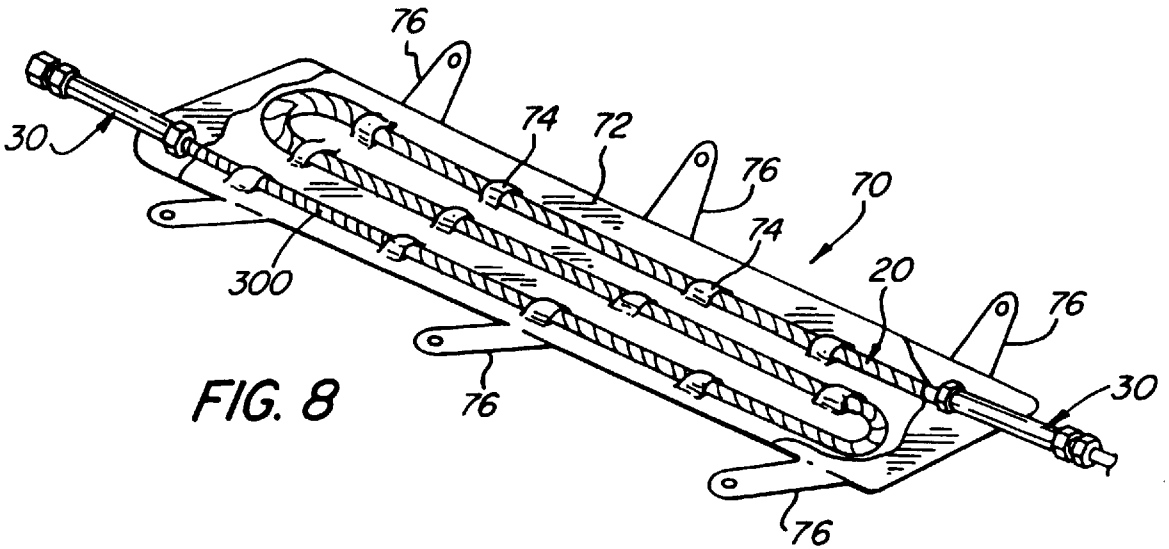
FIG. 8 is an enlarged isometric view of a crib heating unit of the railroad switch heating system of FIG. 1.

Referring now to FIG. 8, the crib heating unit 70 according to the present invention includes a unitary elongate, substantially flat pan-like support 72 of thermally conductive, heat and weather resistant sheet material, such as, for instance, a piece of stainless steel sheeting. A sinuously bent length of the heating cable assembly 20 is arranged over and held to a surface of the support 72 to heat the support substantially uniformly by conduction to an elevated temperature. The cable length 20 is held to a surface of the support 72, preferably to its underside as shown, by any suitable means such as, for instance, stainless steel bands 74 applied over the cable and welded to the support surface at intervals.

The support 72 with the fixed cable length 20 is easily slid into the crib space 9, between the track ties 6 and beneath the connecting rod 8. The thinness and pan-like form of the support 72 and the ability of the cable assembly 20 to bend, enables the unit 70 to be adapted readily to the dimensions and any restrictions of the crib space 9. The unit 70 can be fastened in place advantageously by heat and weather resistant straps 76, such as strips of stainless steel sheeting which are welded to the support 72 at spaced intervals and extend from opposite side edges of the support to be nailed or screwed onto the bordering ties 6. The pan-like support 72 of the crib heating unit 70 distributes the heat from the cable length 20 substantially uniformly over the area of the support and thence by radiation and convection from its upwardly facing surface throughout the crib space 9 of the rod 8 interconnecting the switch rails 4. Any snow or ice reaching the surface of the support 72 is melted, thereby preventing snow and ice from accumulating in the crib space 9.

Although not shown, the crib heating unit 70 can be provided with a pan-like support formed by two layers of substantially flat weather-resistant sheet material, with a length of the heating cable assembly 20 sinuously arranged and sandwiched between the two sheets. The lower sheet can be provided with a layer of heat insulating material to restrict heat losses downward into the track bed.

While a particular form of a heating cable assembly according to the invention has been illustrated in the drawings and described above, it will be evident to persons skilled in the art that this invention may be employed in other forms or ways, and by use of parts differing in form or in manner of connection from those of the illustrated embodiment, while still utilizing the substance of the invention herein disclosed and defined by the claims. Accordingly, while the invention has been described with reference to a particular arrangement of parts, features and the like, these are not intended to exhaust all possible arrangements or features, and indeed many other modifications and variations will be ascertainable to those of skill in the art.

What is claimed is:

1. A connector for joining first and second wires, at least one of which is periodically subject to elongation, the connector comprising:

a protective sleeve having a first end for receiving the first wire and a second end for receiving the second wire;

a heat-absorbing electrically conductive core member received within said protective sleeve for connection to the first wire;

a butt crimp received within said protective sleeve for connection to the second wire; and an electrically conductive expansion joint extending from the core member to the butt crimp.

2. A connector according to claim 1 further comprising a water-tight coupling at each of the first and the second ends of the protective sleeve.

3. A connector according to claim 2 wherein the water-tight coupling between the first end of the protective sleeve and the first wire comprises a weld.

4. A connector according to claim 1 further comprising electrical insulation covering an inner surface of said protective sleeve.

5. A connector according to claim 1 wherein the electrically conductive expansion joint comprises a metal tubular braid.

6. A connector according to claim 5 wherein the metal tubular braid is made of tin-plated copper.

* * * * *